US011515112B2

(12) United States Patent
Iwamoto

(10) Patent No.: US 11,515,112 B2
(45) Date of Patent: Nov. 29, 2022

(54) ELECTROMAGNETIC RELAY

(71) Applicant: Fujitsu Component Limited, Tokyo (JP)

(72) Inventor: Daiei Iwamoto, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 208 days.

(21) Appl. No.: 16/415,548

(22) Filed: May 17, 2019

(65) Prior Publication Data

US 2019/0371552 A1 Dec. 5, 2019

(30) Foreign Application Priority Data

May 31, 2018 (JP) ..... JP2018-104712

(51) Int. Cl.

| | |
|---|---|
| ***H01H 50/42*** | (2006.01) |
| ***H01H 50/64*** | (2006.01) |
| ***H01H 50/24*** | (2006.01) |
| ***H01H 50/30*** | (2006.01) |
| ***H01H 51/01*** | (2006.01) |
| *H01H 51/10* | (2006.01) |

(52) U.S. Cl.

CPC ..... *H01H 50/42* (2013.01); *H01H 50/24* (2013.01); *H01H 50/30* (2013.01); *H01H 50/645* (2013.01); *H01H 51/01* (2013.01); *H01H 51/10* (2013.01)

(58) Field of Classification Search

CPC ..... H01H 50/42; H01H 50/645; H01H 51/10
USPC ..... 335/181, 128, 230
See application file for complete search history.

(56) References Cited

U.S. PATENT DOCUMENTS 3,195,023 A * 7/1965 Mielert ..... H01H 51/01 335/230
3,599,133 A * 8/1971 Richert ..... H01H 51/01 335/230

(Continued)

FOREIGN PATENT DOCUMENTS

JP H0198450 A 4/1989
JP H04282526 A 10/1992

(Continued)

OTHER PUBLICATIONS

Translation of the Reasons for Refusal from counterpart Japanese Application No. 2018-104712, dated Jan. 18, 2022, 4 pp.

*Primary Examiner* — Alexander Talpalatski
(74) *Attorney, Agent, or Firm* — Shumaker & Seiffert, P.A.

(57) ABSTRACT

An electromagnetic relay includes an electromagnet unit, an armature supported so as to be pivotable relative to a yoke by a hinge spring, a contact including a first contact and a second contact, which can switch, in accordance with pivoting of the armature, between a closed contact state and an open contact state, an elastic member which elastically deforms in accordance with pivoting of the armature, and applies a contact force between the first contact and the second contact in the closed contact state, and a magnet which generates an attractive force for retaining the armature in an open contact position corresponding to the open contact state, wherein the armature is retained in the open contact position by a resultant force of a restoring force applied to the armature by the hinge springe, and the attractive force of the magnet.

4 Claims, 13 Drawing Sheets

(56) References Cited

U.S. PATENT DOCUMENTS

| | | | | |
|---|---|---|---|---|
| 4,020,434 | A * | 4/1977 | Jaegle | H01H 51/2236 335/230 |
| 9,646,789 | B2 * | 5/2017 | Chapel | H01H 47/02 |
| 9,754,750 | B2 * | 9/2017 | Cai | H01H 51/01 |
| 2014/0176268 | A1 | 6/2014 | Suzuki et al. | |
| 2018/0005773 | A1 | 1/2018 | Koch et al. | |

FOREIGN PATENT DOCUMENTS

| | | | |
|---|---|---|---|
| JP | 2006196362 | A | 7/2006 |
| JP | 2012054047 | A | 3/2012 |
| JP | 2018010866 | A | 1/2018 |

* cited by examiner

ELECTROMAGNETIC RELAY

This application claims the benefit of JP Application 2018-104712, filed May 31, 2018, the entire contents of which is incorporated herein by reference.

TECHNICAL FIELD

The present invention relates to an electromagnetic relay.

BACKGROUND

In recent years, in electromagnetic relays (hereinafter also referred to as "relays") used in vehicles such as automobiles, it is necessary to prevent malfunctions caused by vibration and impact applied to the relay during operation. In particular, in current holding relays in which an electromagnet is operated to close the contacts and retain the relay in the closed state, the anti-vibration and impact performance is inferior in an open contact state as compared with the closed contact state in which the electromagnet operates.

Plunger-type electromagnetic relays which are configured so as to use a permanent magnet to improve anti-vibration and impact performance in an open state are known (refer to Japanese Patent No. 5307779B). Furthermore, self-holding-type (latching-type) electromagnetic relays in which a rotary armature and a permanent magnet are used are known (refer to Japanese Unexamined Patent Publication (Kokai) No. 2018-10866A).

SUMMARY

When an improvement in the output performance or charging performance (high voltage/high capacity) of a relay is required, a plunger-type relay in which two contacts are connected in series is used so that the load current circuit can be disconnected at two points. Plunger-type relays have a robust structure, but are large in size, and consume a large amount of current. Though power consumption can be reduced by the use of a latching relay, since the ON or OFF state as a relay does not depend on ON or OFF of a driving current, it is difficult to determine a contact failure.

The present invention provides an electromagnetic relay with which a high voltage and a high capacity can be realized without increasing the size or power consumption of the electromagnet.

One aspect of the present disclosure provides an electromagnetic relay, comprising an electromagnet unit comprising a coil, an iron core, and a yoke connected to the iron core, an armature supported so as to be pivotable relative to the yoke by a hinge spring, a contact comprising a first contact and a second contact, which can switch, in accordance with pivoting of the armature, between a closed contact state in which the first contact contacts the second contact and an open contact state in which the first contact is separated from the second contact, an elastic member which elastically deforms in accordance with the pivoting of the armature, and applies a contact force between the first contact and the second contact in the closed contact state, and a magnet which generates an attractive force for retaining the armature in an open contact position corresponding to the open contact state, wherein when the armature is in the open contact position, the armature is retained in the open contact position by a resultant force of a restoring force applied to the armature by the hinge springe, and the attractive force of the permanent magnet.

DETAILED DESCRIPTION

Figure 1:
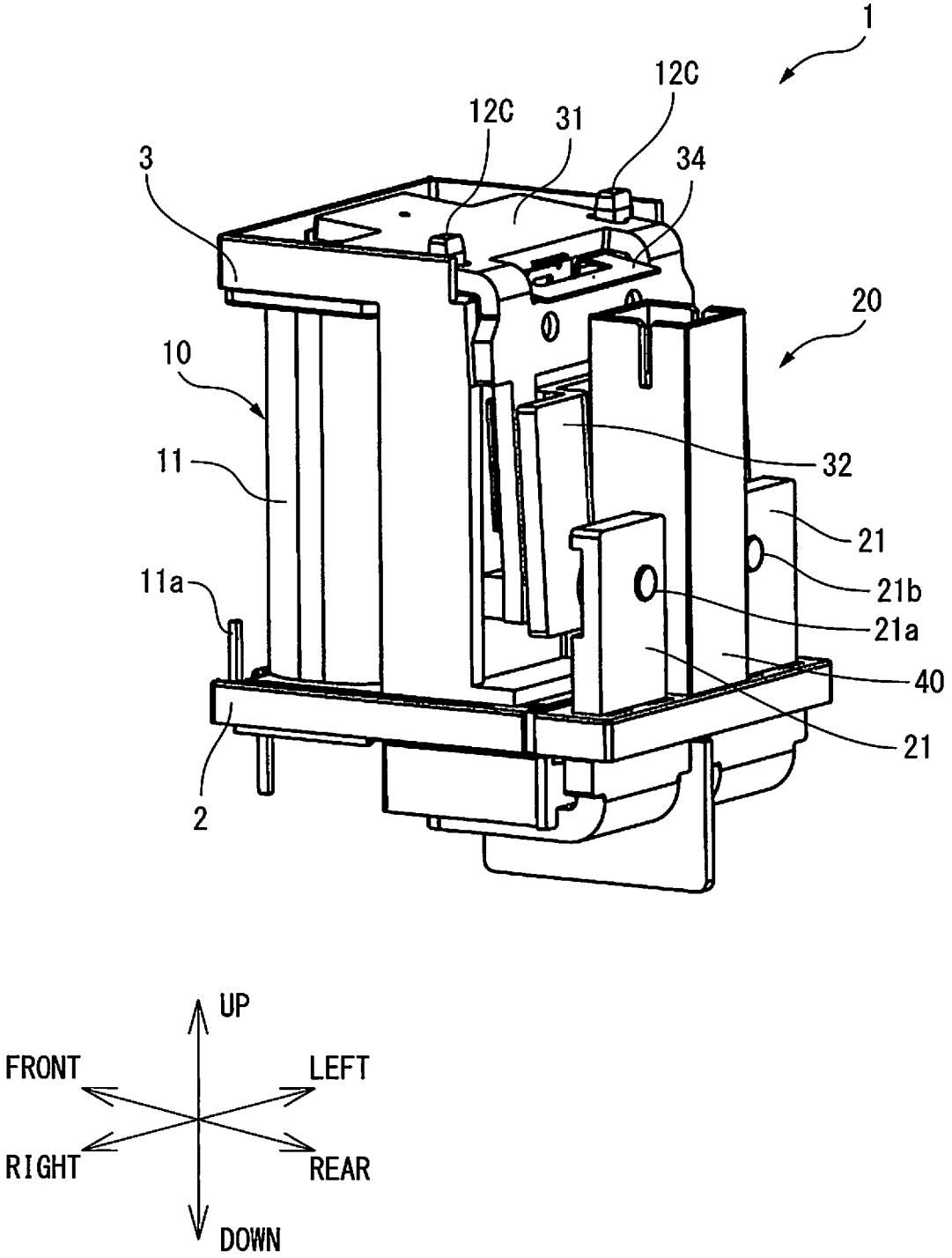
FIG. 1 is a perspective view of the electromagnetic relay according to the present embodiment.

Next, the embodiments of the present disclosure will be explained referring to the drawings. In the referenced drawings, identical portions are assigned the same reference numerals. For the ease of understanding, the scales of the drawings have been appropriately modified. The embodiments depicted in the drawings are merely examples of the execution of the present invention, and the present invention is not limited to the illustrated embodiments.

Hinge-type relays generally include an electromagnet unit, a movable unit which moves as a result of the operation of the electromagnet unit, and a contact mechanism which can switch between contact and non-contact states in accordance with the movement of the movable unit. Since hinge-type relays have a small number of parts with a simple configuration as compared to plunger-type relays or latching relays, they are primarily used as small-sized relays to be mounted on a substrate. Since it is necessary to increase the sectional area of elements such as the movable terminal in consideration of the high voltage and high capacity of hinge-type relays, in order to compensate therefor, it is necessary to increase the electromagnetic force of the electromagnet unit. However, there is a problem in that the size and power consumption of the electromagnet unit increase. In the electromagnetic relay according to an embodiment of the present disclosure described below, a high voltage and high capacity can be realized without an increase in the size or power consumption of the electromagnet unit.

FIGS. 1 to 6 illustrate the configuration of the electromagnetic relay ("relay") 1 according to an embodiment. As described in detail below, the relay 1 is configured so that through use of a permanent magnet, the armature can be retained by a resultant force of the restoring force of a hinge spring and the attractive force of the permanent magnet when the contacts are open. As a result, when compared with a relay in which the armature is retained by only the restoring force of a hinge spring when the contacts are open, the relay 1 is configured such that performance can be improved (high voltage and high capacity) when the contacts are closed while maintaining anti-vibration and impact performance when the contacts are open.

Figure 2:
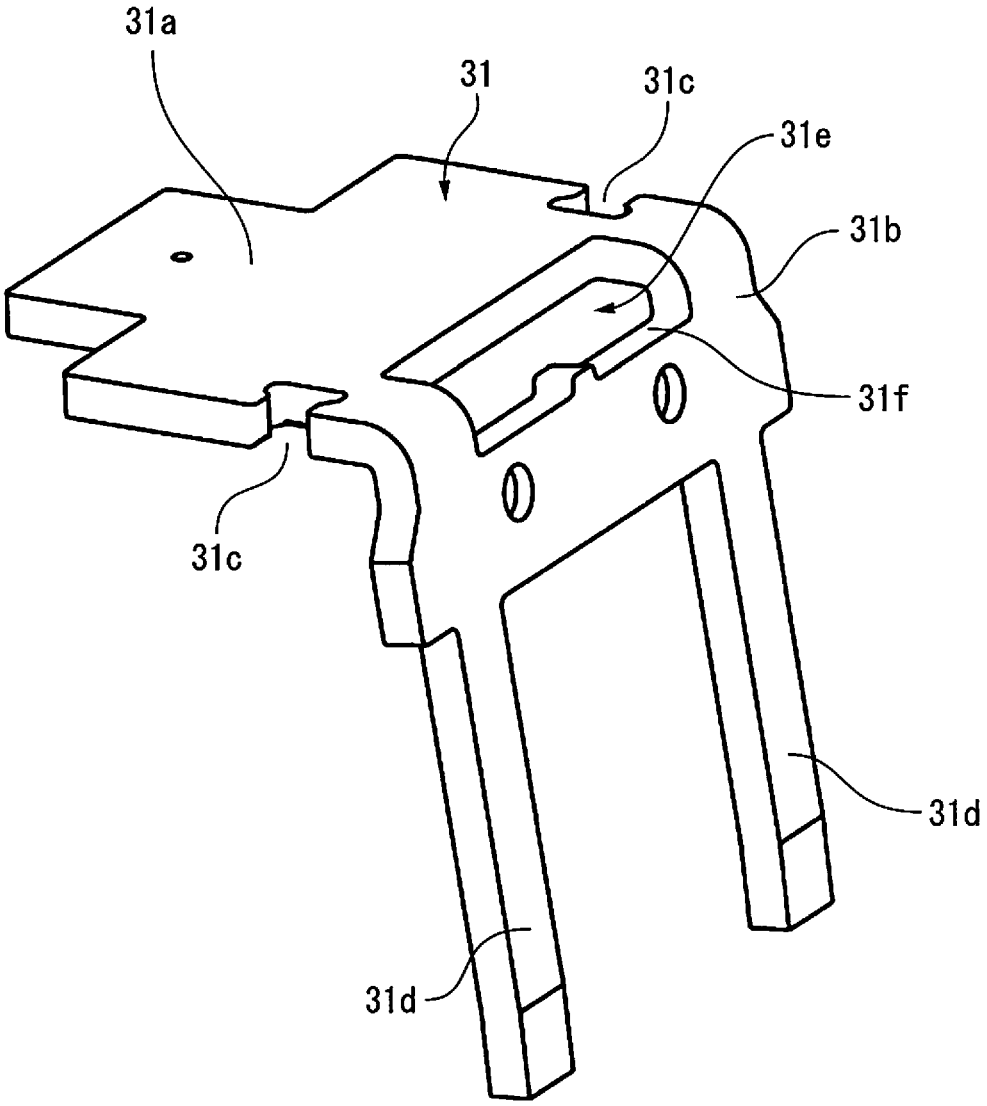
FIG. 2 is a perspective view of an armature used in the electromagnetic relay according to the present embodiment.
Figure 3:
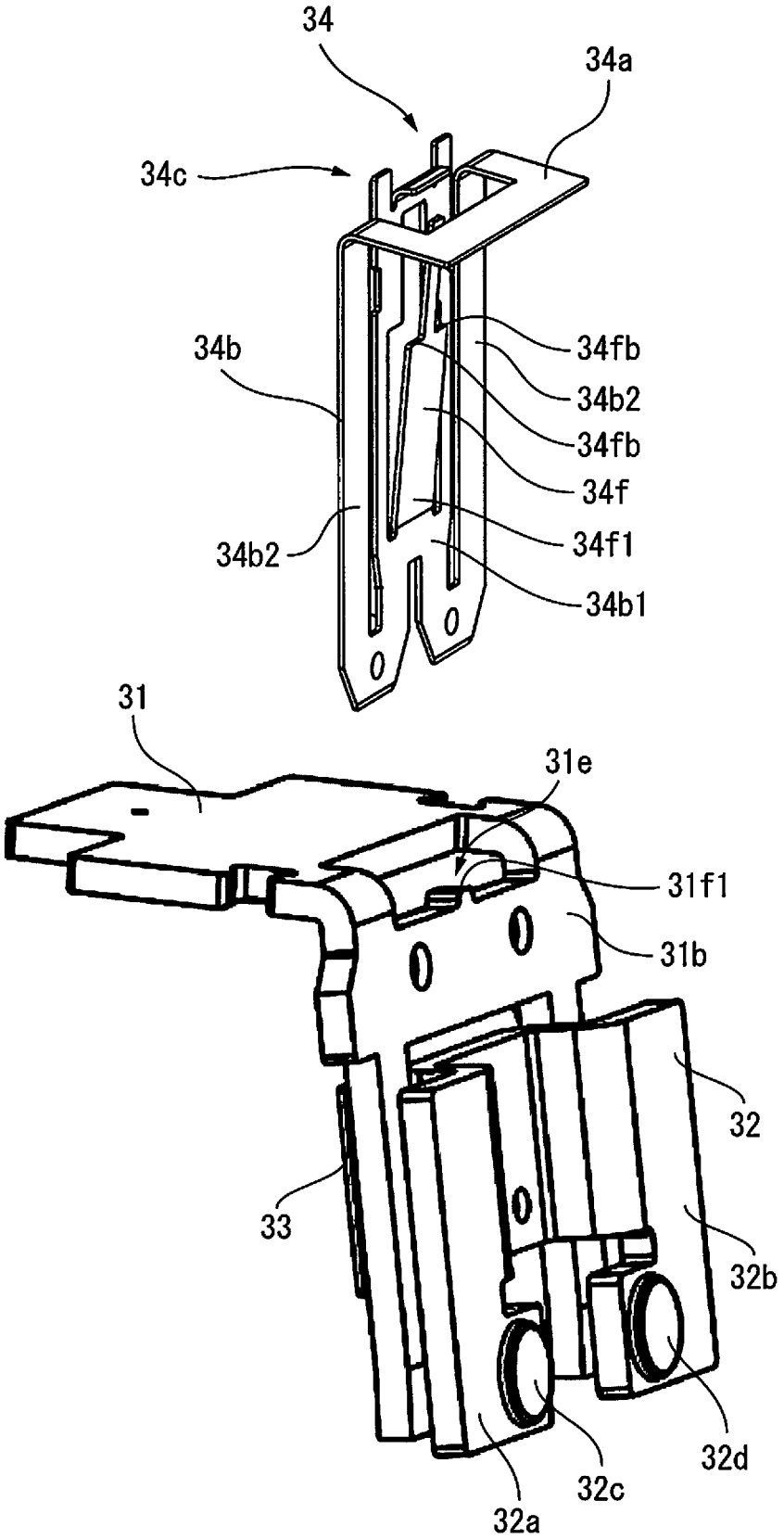
FIG. 3 is a partial assembly view depicting a state in which a movable spring and a movable terminal are assembled with the armature.
Figure 4:
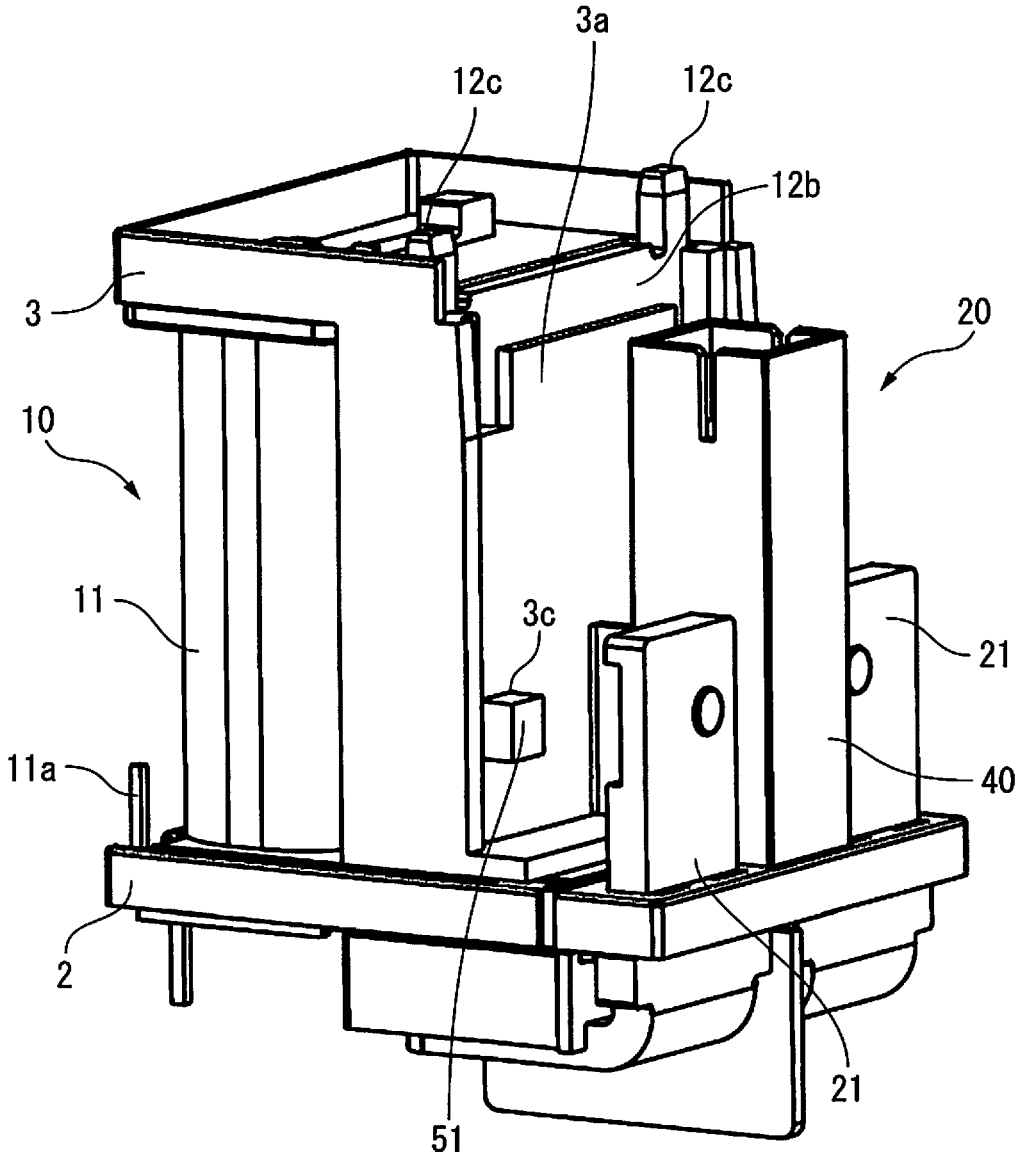
FIG. 4 is a perspective view of the electromagnetic relay from which the assembly of FIG. 3 and a hinge spring have been removed.
Figure 5:
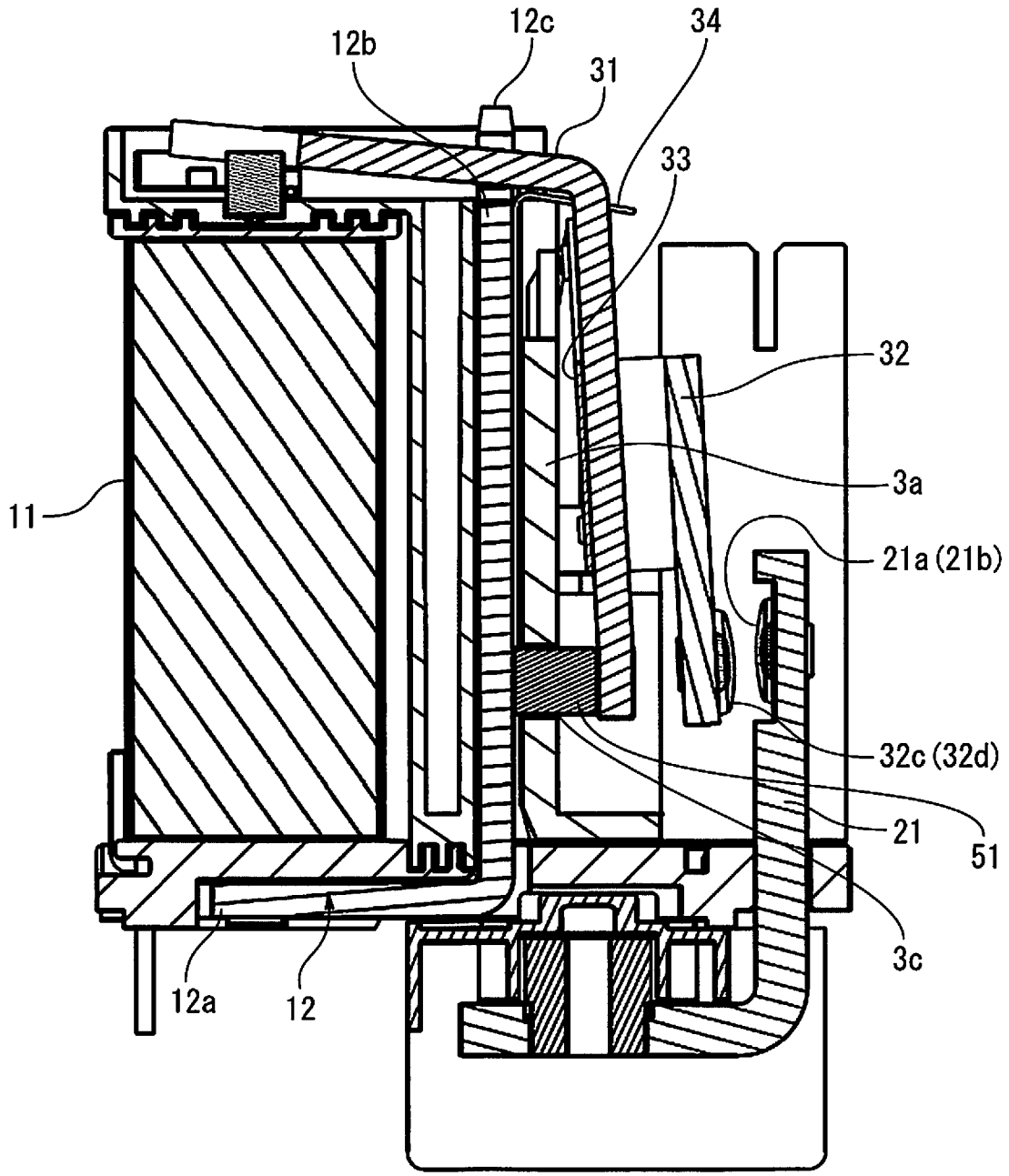
FIG. 5 is a sectional view of the electromagnetic relay according to the present embodiment when the contacts are open.
Figure 6:
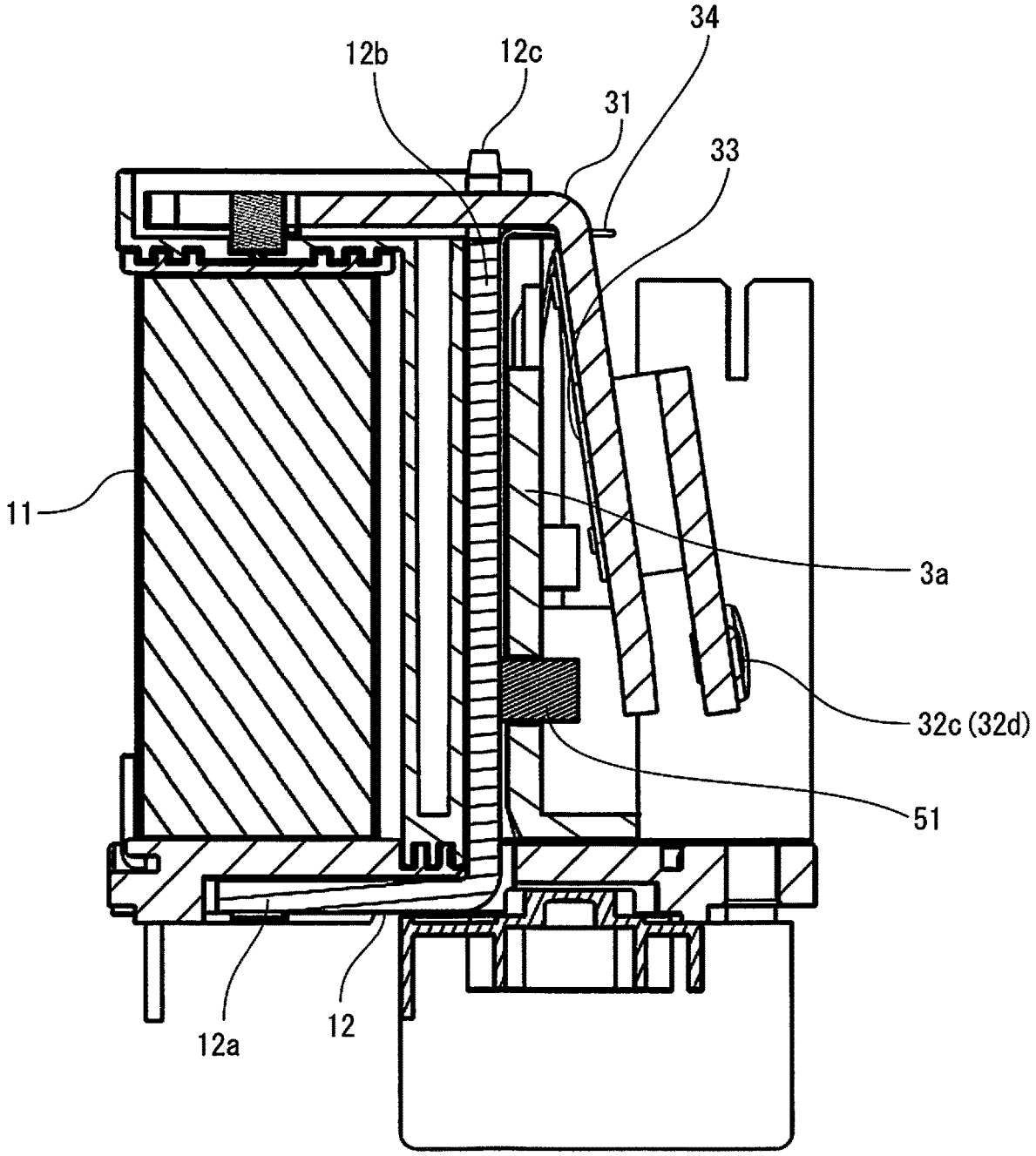
FIG. 6 is a sectional view of the electromagnetic relay according to the present embodiment when the contacts are closed.

FIG. 1 is a perspective view of the relay 1. FIG. 2 is a perspective view of an armature 31 used in the relay 1. FIG. 3 is a partial assembly view depicting a state in which a movable spring 33 and a movable terminal 32 are assembled with the armature 31. FIG. 3 also illustrates a hinge spring 34. FIG. 4 depicts a perspective view of a state in which the assembly of FIG. 3 and the hinge spring 34 have been removed from the relay 1 in order to illustrate the arrangement of a permanent magnet 51. FIGS. 5 and 6 are sectional views of the relay 1 when the contacts are open and when the contacts are closed, respectively. For convenience of explanation, the longitudinal direction of a base 2 is defined as the front-rear directions, and the left-right directions and the up-down directions are defined relative to the front-rear directions as depicted in FIG. 1. For example, the relay 1 is a relay which can be energized with several tens to several hundred volts of DC voltage, and several tens to several hundred amps of current. The relay 1 may also be used to be energized with alternating current.

The relay 1 is configured such that the movable terminal 32 can contact with or separate from two fixed terminals 21 by controlling the turning-on or turning-off of the electromagnet unit 10 to drive the armature 31. As depicted in FIG. 1, the electromagnet unit 10 is mounted on a front-end of a base 2 which is made of a resin, and the movable terminal 32 and two fixed terminals 21, which constitute a contact 20, are arranged on the rear side of the base 2. The electromagnet unit 10 includes a coil 11, an iron core arranged inside the coil 11, and a yoke 12. The yoke 12 has a substantially L-shape in a side view, and includes a lower surface 12*a* which is connected to a lower end of the iron core and which extends rearward along a lower surface of the coil 11, and a side surface 12*b* which is curved upward from the rear end of the lower surface 12*a* and which extends parallel to a side surface of the coil 11.

Two terminals, which are connected to both ends of the coil 11, are arranged on the front-end of the base 2. In FIG. 1, only a single terminal 11*a* is depicted. An insulating cover 3 formed so as to cover the peripheral part of the upper surface and the side surface of the rear side of the electromagnet unit 10 is arranged on the base 2.

As depicted in FIG. 2, the armature 31 has a substantially L-shape in a side view, and includes an upper surface 31*a*, a side surface 31*b* which is formed so as to curve downward from one end of the upper surface 31*a*, and two arms 31*d* which are formed so as to extend downwards from the sides of the side surface 31*b* in the left and right directions. The side surface 31*b* forms an angle slightly greater than a right angle with respect to the upper surface 31*a*. Notches 31*c* are formed on both sides of the upper surface 31*a* in the left-right directions, and an aperture 31*e* for inserting the hinge spring 34 is formed in the curved part between the upper surface 31*a* and the side surface 31*b*. The two notches 31*c* engage with two protrusions 12*c* on the upper ends of the yoke 12 when the armature 31 is assembled.

As depicted in FIG. 3, one end of a movable spring 33 is secured to the front surface of the side surface 31*b*. The movable spring 33 is elastically deformed relative to the one end secured to the side surface 31*b*. The movable terminal 32 is secured to the rear side of the movable spring 33 between the two arms 31*d*. The movable terminal 32 includes movable contacts 32*c*, 32*d* on the ends 32*a*, 32*b* thereof, respectively. In this configuration, when the electromagnet unit 10 is turned on and the upper surface 31*a* of the armature 31 is attracted to the electromagnet unit 10 (refer to FIG. 6), the arm 31*d* pivots rearwardly together with the side surface 31*b*, and as a result, the movable terminal 32 contacts the fixed terminal 21. When the movable terminal 32 contacts the fixed terminal 21, the movable spring 33 elastically deforms, and a contact force is generated to contact the movable terminal 32 with the fixed terminal 21. When the movable contacts 32*c*, 32*d* contact the fixed contacts 21*a*, 21*b*, the two fixed contacts 21 are electrically connected.

The hinge spring 34 will be described with reference to FIG. 3. The hinge spring 34 has a shape which has been bent into a substantially L-shape, and includes an upper surface 34*a* and a side surface 34*b* which extends downwards from the upper surface 34*a*. The side surface 34*b* includes a punched central part 34*b*1. The central part 34*b*1 includes an engagement part 34*c* which presses the armature 31 in the forward direction in an upper end thereof. The side surface 34*b* includes two sides 34*b*2 which extend upwards from the lower-end of the central part 34*b*1 and which are continuous with the upper surface 34*a*. The central part 34*b*1 and the sides 34*b*2 are continuous in the lower ends thereof. A stopper 34*f* is formed at the substantially center of the central part 34*b*1 so as to be inclined toward the rear side with respect to a lower end 34*f*1 connected to the central portion 34*b*1. The hinge spring 34 is inserted from above between the yoke 12 and the insulating cover 3 through the aperture 31*e*, and shoulders 34*fb* of the stopper 34*f* are hooked onto the protrusions provided on the insulating cover 3 to secure the hinge spring 34. In the state in which the hinge spring 34 is assembled, the upper surface 34*a* abuts against the protrusion 31*f*1 protruding from the lower end 31*f* of the aperture 31*e*. Further, the shoulders 34*fb* are hooked into the protrusions provided in the insulating cover 3. As a result, the armature 31 is supported so as to be pivotable relative to the yoke 12 by the hinge spring 34. When the hinge spring 34 is assembled, a restoring force is applied to the armature 31 by the hinge spring 34. The restoring force applied by the hinge spring 34 becomes larger when the armature 31 moves from the position corresponding to the open contact position in FIG. 5 to the position corresponding to the closed contact position in FIG. 6.

As depicted in FIG. 4, two permanent magnets 51 are adhered to the lower part of the side surface 12*b*. Only the permanent magnet 51 on the right-side is illustrated. The permanent magnets 51 pass through through-holes 3*c* formed in a side surface 3*a* of the insulating cover 3 and are exposed on the rear side.

The operation of the relay 1 will be described. When the electromagnet unit 10 is turned off, the side surface 31*b* and the arms 31*d* of the armature 31*d* are urged toward the side surface 12*b* by the restoring force of the hinge spring 34 as depicted in FIG. 5, and the lower ends of the arms 31*d* are attracted by the attractive forces of the permanent magnets 51. Thus, when the contacts are open, the armature 31 is retained in a state in which the arms 31*d* contact the permanent magnets 51. As described above, the contact-open state is retained by a combination of the restoring force of the hinge spring 34 and the attractive forces of the permanent magnets 51.

Conversely, when the electromagnet unit 10 is turned on, the upper surface 31*a* is attracted by the electromagnet unit 10, and the armature 31 pivots counterclockwise as depicted in FIG. 6 against the retention force when the contacts are open. As a result, the arms 31*d* separate from the permanent magnets 51, the movable contacts 32*c*, 32*d* contact the fixed contacts 21*a*, 21*b*, and a closed contact state is established. The fixed terminal 21 has been omitted in FIG. 6 for the convenience of illustration. The closed contact state is retained while the electromagnet unit 10 is turned on.

As depicted in FIG. 1, a magnet 40, which is a permanent magnet, may be disposed between the two fixed terminals 21. The magnet 40 extends and eliminates arcs generated between the movable contact 32*c* and the fixed contact 21*a* or between the movable contact 32*d* and the fixed contact 21*b* when the movable terminal 32 separates from the fixed terminals 21 in accordance with Fleming's left-hand rule.

Figure 7:
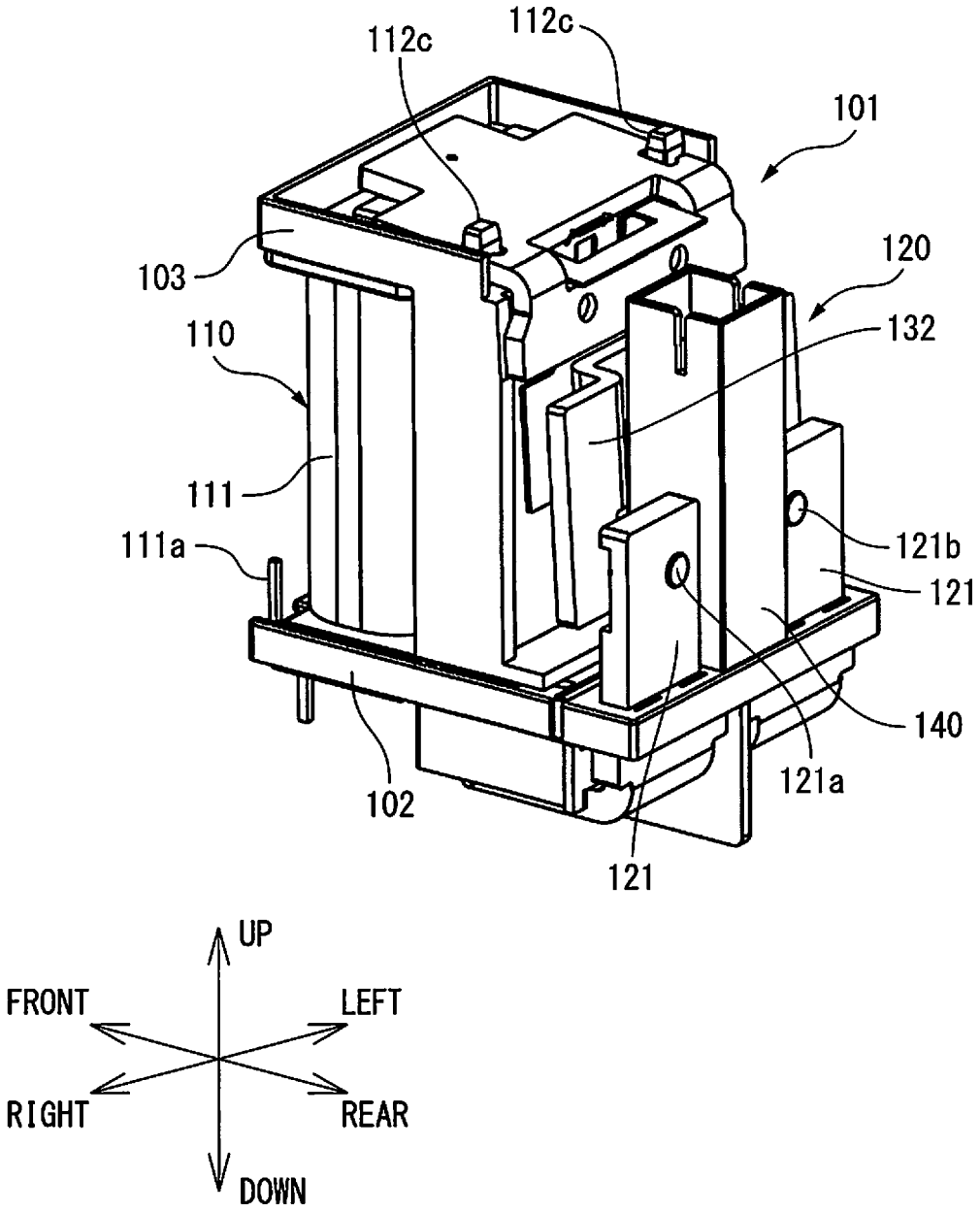
FIG. 7 is a perspective view of an electromagnetic relay according to a Comparative Example.
Figure 8:
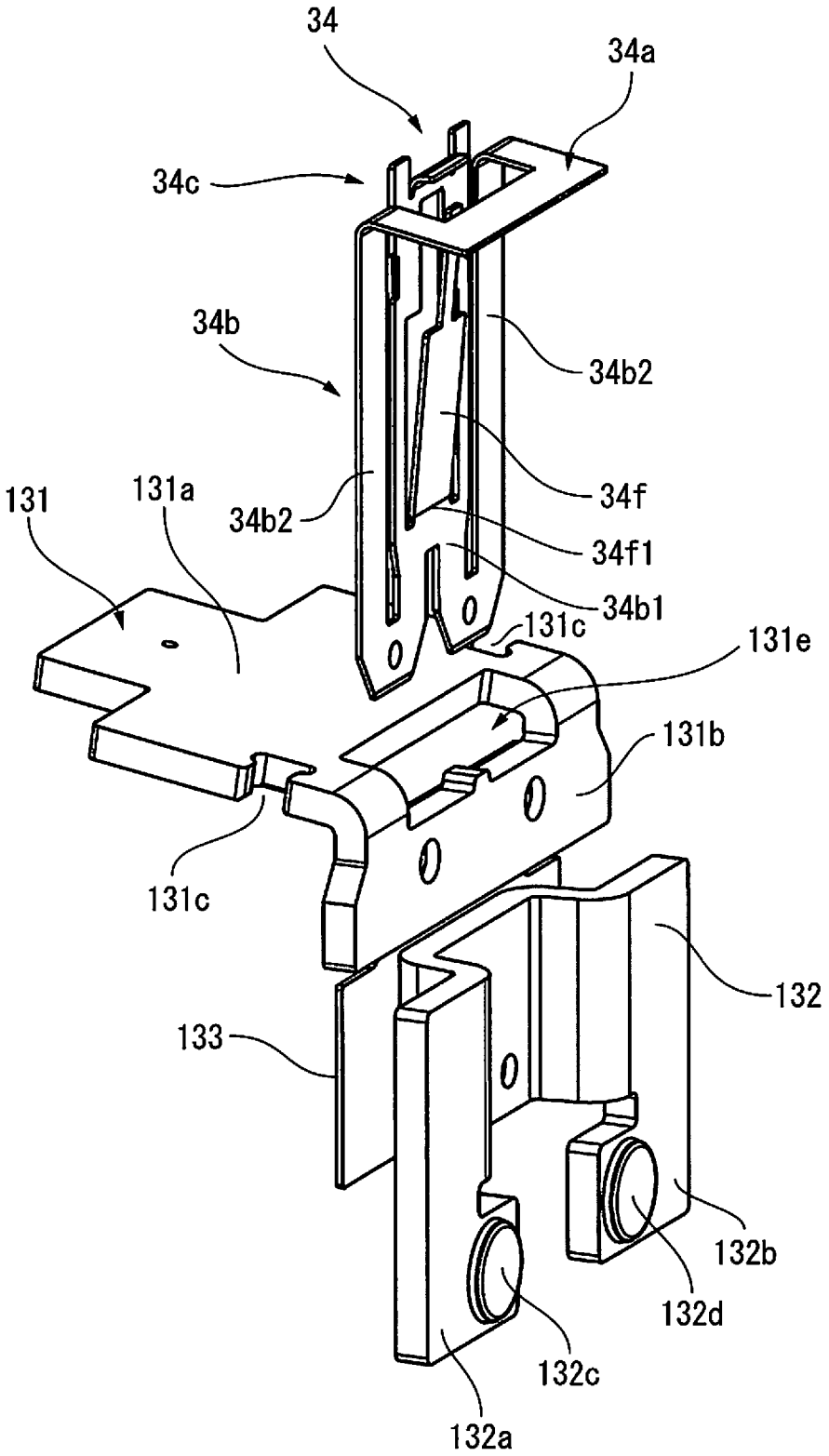
FIG. 8 is a partial assembly view depicting a state in which a movable spring and a movable terminal are assembled with an armature in the Comparative Example.
Figure 9:
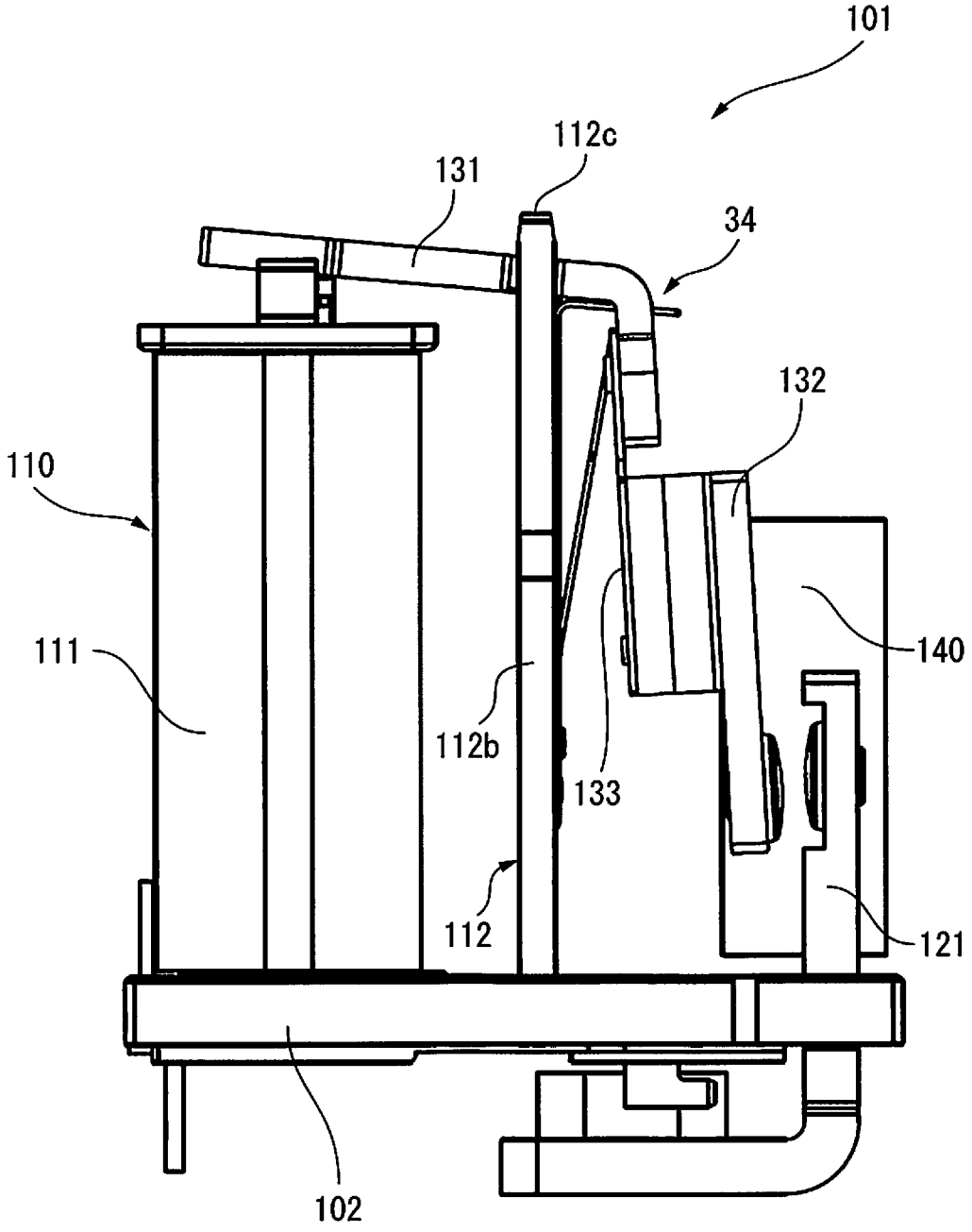
FIG. 9 is a side view of the electromagnetic relay according to the Comparative Example when the contacts are open.

A relay 101 according to a Comparative Example will be described below with reference to FIGS. 7 to 9. FIGS. 7 to 9 illustrate the relay 101. FIG. 7 is a perspective view of the relay 101. FIG. 8 is a partial assembly view depicting a state in which a movable spring 133 and a movable terminal 132 are assembled with an armature 131. FIG. 9 is a side view of the relay 101 when the contacts are open. For the ease of understanding, below, the front-rear directions, the left-right directions, and the up-down directions of the relay 101 are defined in the same manner as in FIG. 1.

The relay 101 does not include permanent magnets for attracting the armature, and is configured so that the armature is retained by only the restoring force of the hinge spring when the contacts are open. In the relay 101, the state of the load on hinge spring is designed such that the restoring force of the hinge spring when the contacts are open is the same as the retaining force on the armature 31 of the relay 1 when the contacts are open. In the relay 101, a hinge spring that is the same as the hinge spring 34 used in the relay 1 is used.

As depicted in FIG. 7, an electromagnet unit 110 is mounted on the front side of a base 102, and a movable terminal 132 and two fixed terminals 121 constituting a contact 120 are disposed on the rear side of the base 102. The electromagnet unit 110 includes a coil 111, an iron core disposed inside the coil 111, and a yoke 112. The yoke 112 has a substantially L-shape in a side view, and includes a bottom which is connected to a lower end of the iron core and which extends rearwards along the lower surface of the coil 111, and a side surface 112*b* which is bent upwardly from the bottom and which extends parallel to the side surface of the coil 111.

Two terminals which are connected to the ends of the coil 111 are arranged on the front end of the base 102 (only one terminal 111*a* is illustrated in FIG. 7). An insulating cover 103 which covers the upper surface and the rear side of the electromagnet unit 110 is disposed on the base 102.

As depicted in FIG. 8, the armature 131 has a substantially L-shape in a side view, and includes an upper surface 131*a* and a side surface 131*b* which is bent downwards from one end of the upper surface 131*a*. Notches 131*c* are formed in the side surfaces of the upper surface 131*a* in the left-right directions, and an aperture 131*e* for inserting the hinge spring 34 is formed in the curved part between the upper surface 131*a* and the side surface 131*b*. The two notches 131*c* engage with two protrusions 112*c* on the upper end of the yoke 112 when the armature 131 is assembled. The armature 131 has a shape in which the arms 31*d* are removed from the armature 31.

As depicted in FIG. 8, a movable spring 133 is secured to the surface of the side surface 131*b*. The movable spring 133 elastically deforms relative to the one end which is secured to the side surface 131*b*. A movable terminal 132 is secured in the center of the movable spring 133. The movable terminal 132 includes two movable contacts 132*c*, 132*d* on the ends 132*a*, 132*b* thereof. When the electromagnet unit 110 is turned on and the upper surface 131*a* is attracted by the electromagnet unit 110, the side surface 131*b* pivots toward the rear side, and as a result, the movable terminal 132 contacts the fixed terminal 121. When the two movable contacts 132*c*, 132*d* contact the fixed contacts 121*a*, 121*b*, the two fixed contacts 121 are electrically connected.

The hinge spring 34 is inserted from above between the yoke 112 and the insulating cover 103 through the aperture 131*e*, and the shoulders 34*tb* of the stopper 34*f* are hooked onto protrusions provided on the insulating cover 103 to secure the hinge spring 34.

Next, the operation of the relay 101 will be described. In a state in which the electromagnet unit 110 is turned off, the side surface 131*b* of the armature 131 is urged toward the side surface 112*b* by the restoring force of the hinge spring 34 as depicted in FIG. 9, and is retained in an opened contact state. In the relay 101, the opened contact state is retained by the restoring force of the hinge 34.

Conversely, when the electromagnet unit 110 is turned on, the upper surface 131*a* is attracted by the electromagnet unit 110, and the armature 131 pivots counterclockwise as depicted in FIG. 9 against the retention force when the contacts are open described above. As a result, the movable contacts 132*c*, 132*d* contact the fixed contacts 121*a*, 121*b*, and a closed contact state is established. The closed contact state is retained while the electromagnet unit 110 is turned on.

As depicted in FIG. 7, a magnet 140 may be disposed between the two fixed terminals 121. Similar to the magnet 40, the magnet 140 extends and eliminates arcs generated between the movable contact 132*c* and the fixed contact 121*a* or between the movable contact 132*d* and the fixed contact 121*b* when the movable terminal 132 separates from the fixed terminals 121.

Figure 10:
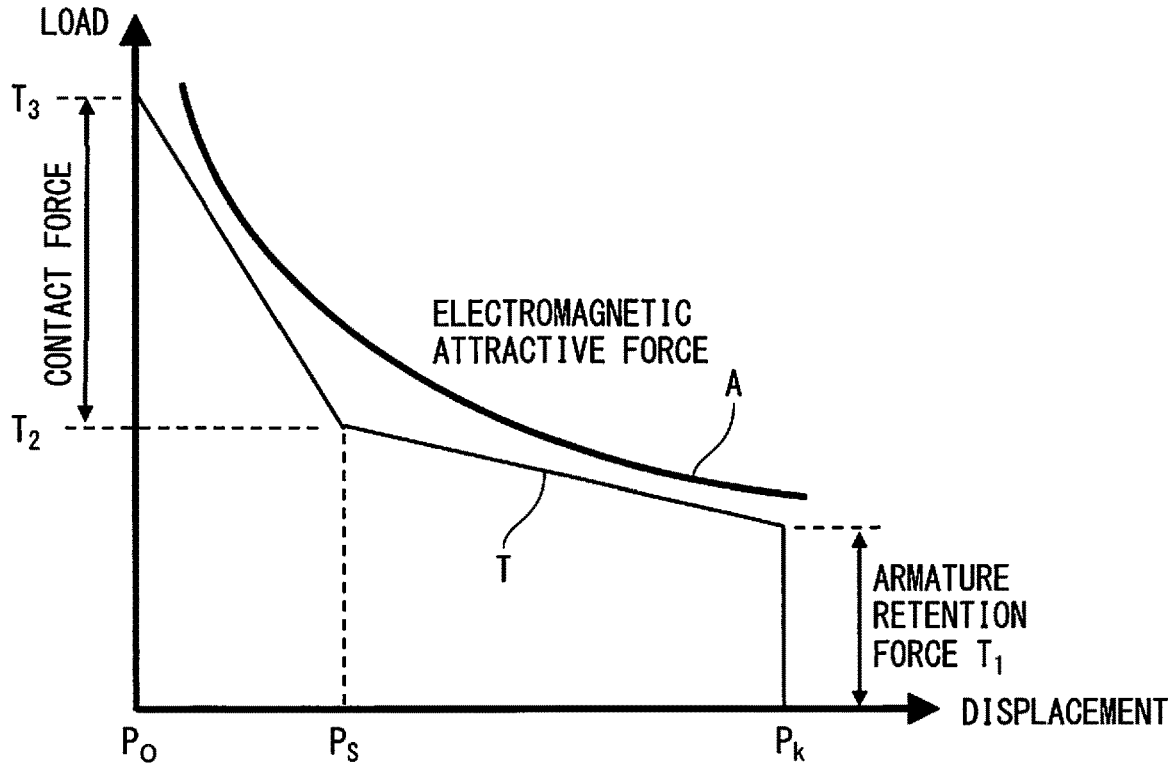
FIG. 10 is a graph depicting the spring load characteristics of the electromagnetic relay according to the Comparative Example.
Figure 11:
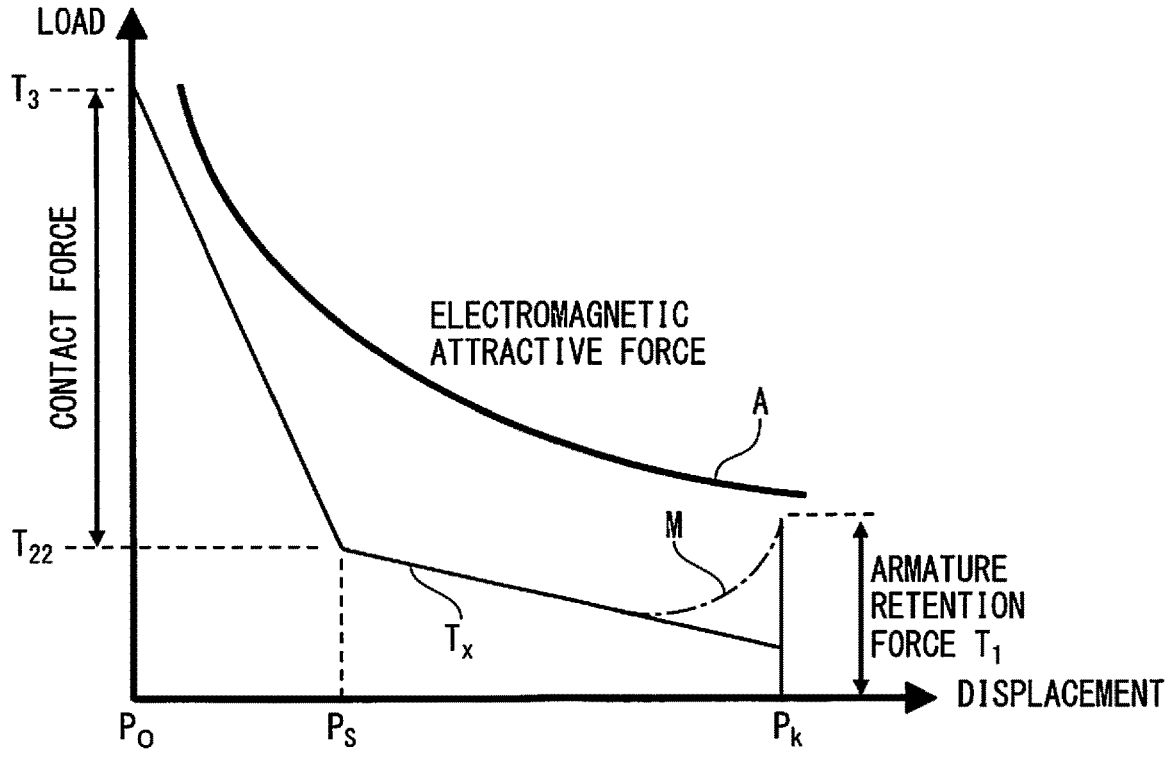
FIG. 11 is a graph depicting the spring load characteristics of the electromagnetic relay according to the present embodiment.

Next, the relationships between the spring load on the armature and the displacement of the armature (hereinafter referred to as "spring load characteristics") for the relay 1 according to the present embodiment and the relay 101 according to the Comparative Example will be described with reference to FIGS. 10 and 11. FIG. 10 is a graph depicting the spring load characteristics of the relay 101. FIG. 11 is a graph depicting the spring load characteristics of the relay 1. In FIGS. 10 and 11, the horizontal axis represents the displacement of the armature and the vertical axis represents the spring load exerted by the hinge spring and the movable spring on the armature. On the horizontal axis of the graphs, the origin position $P_0$ corresponds to a closed contact state in which the armature is attracted by the electromagnet and is most displaced in the counterclockwise direction in FIG. 5 or FIG. 9, and the right-side displacement position $P_k$ corresponds to the open contact state in which the electromagnet is turned off and the armature is most displaced clockwise in FIG. 5 or FIG. 9.

In FIG. 10, the solid line T represents the spring load applied to the armature 131 in the relay 101 of the Comparative Example and the thick line A represents the attractive force due to the electromagnet 110. At position $P_k$, the state of the armature 131 is retained by the restoring force of the hinge spring 34. At this time, the retention force is defined as the armature retention force $T_1$. The armature retention force $T_1$ represents the anti-vibration and impact performance of the relay 101 when the contacts are open. If the external forces such as vibration and impact applied to the relay 101 are equal to or less than the armature retention force $T_1$, the open contact state is stably maintained.

When the electromagnet 110 is turned on and the attractive force of the electromagnet 110 begins to act, the armature 131 pivots counterclockwise in FIG. 9, and the displacement position moves from $P_k$ to the left side along the horizontal axis. At that time, the spring load T applied by the hinge spring 34 on the armature 131 increases. When the armature 131 reaches position $P_S$, the movable terminal 132 contacts the fixed terminal 121. In accordance with the increase of the attractive force from the electromagnet 110 on the armature 131, the armature 131 pivots further counterclockwise, and the movable terminal 132 is pushed further toward the rear side until the armature 131 reaches position $P_0$. In the range in which the armature 131 is moving from position $P_S$ to position $P_0$, the rate of increase of the spring load becomes greater than in the range from position $P_k$ to position $P_S$, since the load caused by the movable spring 133 acts on the armature 131 as a spring load. When the spring load at position $P_S$ of the armature 131 is defined as $T_2$, and the spring load at displacement position $P_0$ of the armature 131 is defined as $T_3$, the force represented by $T_3$-$T_2$ corresponds to the contact force caused by the movable spring 133 for maintaining the movable terminal 132 to contact the fixed terminal 121. When the external forces such as vibration and impact applied to the relay 101 in the closed contact state are less than or equal to the contact force, the closed contact state is reliably maintained. The displacement range from position $P_S$ to $P_0$ corresponds to the displacement of the armature from the time when the movable terminal 132 contacts the fixed terminal 121 until the upper surface 131*a* closely contacts the upper end of the iron core, which is also referred to as contact following.

The spring load characteristics of the relay 1 according to the present embodiment will be described with reference to FIG. 11. In FIG. 11, the solid line $T_X$ represents the spring load on the armature 31 and the thick line A represents the attractive force due to the electromagnet 10. The characteristics of the attractive force on the relay 1 due to the electromagnet 10 (graph A of FIG. 11) are equal to the characteristics of the attractive force on the relay 101 due to the electromagnet 110 (graph A of FIG. 10). In FIG. 11, the broken-line M represents the attractive force acting on the armature 31 due to the permanent magnet 51.

As can be understood from FIG. 11, in the relay 1, the installation state of the hinge spring 34 and the magnetic force of the permanent magnet 51 are set so that the resultant force of the restoring force of the hinge spring 34 and the attractive force of the permanent magnet 51 is equal to the armature retention force $T_1$ of FIG. 10 at position $P_k$. Specifically, the load applied to the hinge spring at displacement position $P_k$, i.e., the restoring force of the hinge spring 34, can be set lower as compared to the relay 101.

When the electromagnet 10 is turned on and the attractive force of the electromagnet 10 begins to act, the armature 31 begins to pivot counterclockwise in FIG. 5, and the displacement position moves from $P_k$ to the left side along the horizontal axis. At this time, the spring load $T_X$ applied to the armature 31 by the hinge spring 34 begins to increase. When the armature 31 reaches position $P_S$, the movable terminal 32 contacts the fixed terminal 21. When the attractive force of the electromagnet 10 further increases, the armature 31 pivots further counterclockwise, and the movable terminal 32 is pushed further to the rear side until the armature 31 reaches position $P_0$. In the range in which the armature 31 moves from position $P_S$ to position $P_0$, the rate of increase of the spring load becomes greater than in the range from position $P_k$ to position $P_S$ since the load is additionally applied to the armature 31 by the movable spring 33 as a spring load.

The spring load T22 caused by the hinge spring 34 at position $P_S$ in FIG. 11 is smaller than the load $T_2$ at position $P_S$ in FIG. 10. The force represented by $T_3$-$T_{22}$ corresponds to the contact force for maintaining the movable terminal 32 to contact the fixed terminal 21. As can be understood by comparing FIG. 11 and FIG. 10, a contact retention force greater than that of the relay 101 can be ensured in the relay 1 of the present embodiment. In the relay 1, the contact force caused by the movable spring 33 for pressing the movable terminal 32 against the fixed terminal 21 at position $P_0$ can be made stronger than the relay 101 by a magnitude corresponding to $(T_3-T_{22})-(T_3-T_2)$.

Thus, according to the present embodiment, the performance when the contacts are closed can be improved while maintaining the armature retention force when the contacts are open equal to that of the Comparative Example. In the present embodiment, the heat generated at the contact is reduced since the contact force can be increased, whereby a greater load current can pass therethrough. In other words, according to the present embodiment, a high voltage and high capacity can be realized while maintaining an armature retention force when the contacts are open equal to that of the Comparative Example. Since the contact force can be increased, the anti-vibration and anti-impact performance can be improved.

Figure 12:
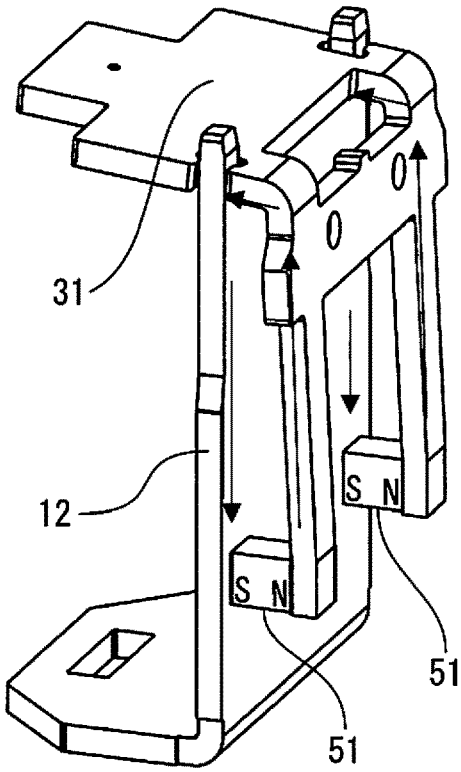
FIG. 12 is a view detailing the polarity of a permanent magnet and the magnetic field inside a yoke.

The polarity of the permanent magnet 51 will be described. As depicted in FIG. 12, when the two permanent magnets 51 are arranged so as to have the same polarity, downward magnetic fields are generated in the yoke 12 as indicated by the arrows. In this case, since the yoke 12 has a magnetic polarity, the pull-in voltage as a relay may differ depending on the energizing direction of the coil 11. Thus, in this case, it is preferable to designate the polarity in the energizing direction of the coil 11.

Figure 13:
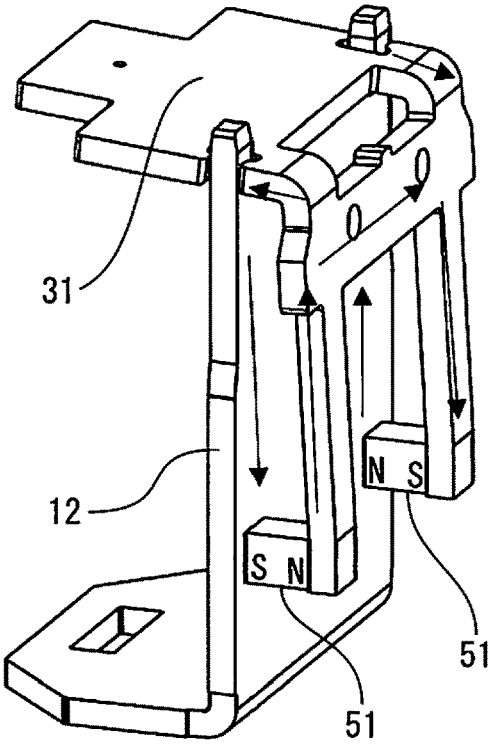
FIG. 13 is a view detailing the polarity of the permanent magnet and the magnetic field inside the yoke.

Conversely, as depicted in FIG. 13, when the permanent magnets 51 are arranged so as to have different polarities, downward and upward magnetic fields as depicted by the arrows in the drawing are generated in the yoke 12, whereby a magnetic polarity is not generated in the yoke 12. Thus, in this case, it is not necessary to designate the polarity in the energizing direction of the coil 11.

Though the present invention has been described above using typical embodiments, a person skilled in the art could understand that the embodiments described above can be changed and various other modifications, omissions, or additions can be made without deviating from the scope of the present invention.

The arrangement and number of permanent magnets 51 in the embodiments are merely exemplary and are not limited to the configurations described in the embodiments. The shape of the armature 131 is not limited to the configuration described in the embodiments.

Figure 14:
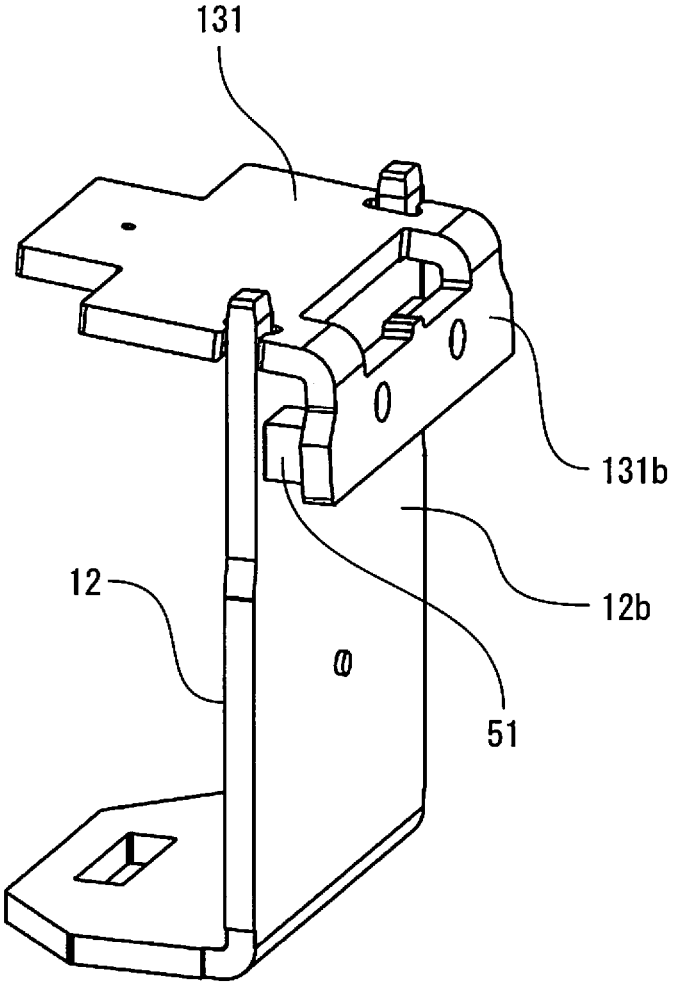
FIG. 14 is a view depicting a modified example of the arrangement of the permanent magnet and the armature.

FIG. 14 is a modified example related to the arrangement of the permanent magnets 51 and the shape of the armature. In FIG. 14, permanent magnets 51 are arranged on the upper ends of the side surface 12*b*. In this case, the armature 131 of the comparative example can be used as an armature. In the present modified example, the permanent magnets 51 attract the side surface 131*b* of the armature 131 when the contacts are open.

Figure 15:
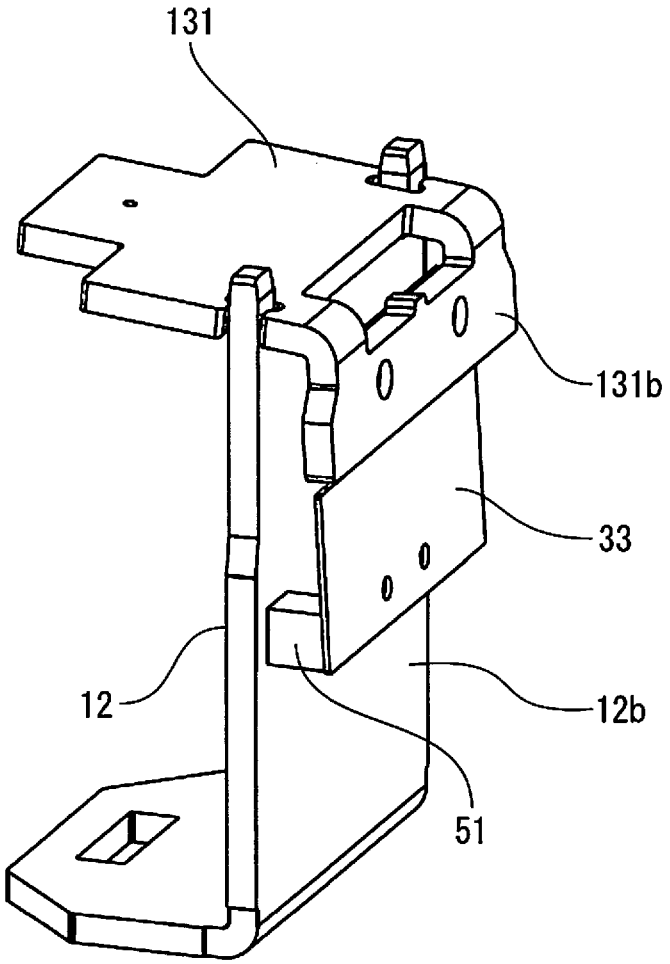
FIG. 15 is a view depicting another modified example of the arrangement of the permanent magnet and the armature.

FIG. 15 depicts another modified example related to the arrangement of the permanent magnets. In the present modified example as well, the armature 131 can be used as an armature. In the present modified example, the permanent magnets 51 are arranged on the portions of the side surface 12*b* that face the lower end of the movable spring 33 connected to the armature 131. The permanent magnets 51 attract the movable spring 33 secured to the armature 131 when the contacts are open. In the present modified example, the movable spring 33 is formed of a magnetic material.

When the number of permanent magnets adhered to the side surface 12*b* of the yoke 12 is one, the armature 31 can be formed so as to extend from the side surface 31*b* as a single plate extension instead of two arms 31*d* extending from the side surface 31*b*. In this case, the permanent magnet attracts the extension.

The structure of the embodiment described above can be used in various types of relays. For example, though the embodiment is configured such that the armature contacts and separates the movable terminal 32 with and from the fixed terminal 21, the present invention can also be applied to an relay configured to open and close contacts using a card moved in conjunction with an armature. In this case, the contact can be constituted by, for example, a movable contact spring and a fixed contact spring that pivot along with the movement of the card.

What is claimed is:

1. An electromagnetic relay, comprising:

an electromagnet unit comprising a coil, an iron core, and a yoke connected to the iron core;

an armature supported so as to be pivotable relative to the yoke by a hinge spring;

a contact comprising a first contact and a second contact, which can switch, in accordance with pivoting of the armature, between a closed contact state in which the first contact contacts the second contact and an open contact state in which the first contact is separated from the second contact;

an elastic member which elastically deforms in accordance with the pivoting of the armature, and applies a contact force between the first contact and the second contact in the closed contact state; and a magnet which generates an attractive force for retaining the armature in an open contact position corresponding to the open contact state, wherein:

the yoke has a side wall extending parallel to a side surface of the coil along an axial direction of the coil, the magnet is disposed, on a side on which the contact is disposed, on the side wall of the yoke such that one of magnetic poles of the magnet is directed, in a direction perpendicular to an axial direction of the coil, toward the side wall of the yoke and the other of the magnetic poles is directed, in the direction perpendicular to the axial direction of the coil, to a direction away from the side wall surface of the yoke, and when the armature is in the open contact position, the armature is retained in the open contact position by a resultant force of a restoring force applied to the armature by the hinge springe and the attractive force of the magnet.

2. The electromagnetic relay according to claim 1, further comprising a base, wherein the electromagnet unit is disposed on one end side of the base, the contact is disposed on the base on the other end side opposite the one end, the first contact is formed on a movable terminal which is attached to the armature via a movable spring as the elastic member, and the second contact is formed on a fixed terminal attached to the base.

3. The electromagnetic relay according to claim 2, wherein the coil is arranged on the base so that an axis of the coil is perpendicular to the base, the yoke has a substantially L-shaped cross-sectional shape, and comprises a lower surface connected to an end of the iron core of the coil on the base side, the magnet is adhered to a surface of the side surface of the yoke on the contact side, the armature has a substantially L-shaped cross-sectional shape and is pivotably engaged with a tip of the side surface of the yoke, the armature comprises an upper surface facing the other end side of the iron core of the coil, and a side surface along the side surface of the yoke, and the magnet attracts the side surface of the armature in the open contact state.

4. An electromagnetic relay, comprising:

an electromagnet unit comprising a coil, an iron core, and a yoke connected to the iron core;

an armature supported so as to be pivotable relative to the yoke by a hinge spring;

a contact comprising a first contact and a second contact, which can switch, in accordance with pivoting of the armature, between a closed contact state in which the first contact contacts the second contact and an open contact state in which the first contact is separated from the second contact;

an elastic member which elastically deforms in accordance with the pivoting of the armature, and applies a contact force between the first contact and the second contact in the closed contact state; and a magnet which generates an attractive force for retaining the armature in an open contact position corresponding to the open contact state, wherein, when the armature is in the open contact position, the armature is retained in the open contact position by a resultant force of a restoring force applied to the armature by the hinge springe and the attractive force of the magnet, the electromagnetic relay further comprising a base, wherein the electromagnet unit is disposed on one end side of the base, the contact is disposed on the base on the other end side opposite the one end, the first contact is formed on a movable terminal which is attached to the armature via a movable spring as the elastic member, and the second contact is formed on a fixed terminal attached to the base, wherein:

the coil is arranged on the base so that an axis of the coil is perpendicular to the base, the yoke has a substantially L-shaped cross-sectional shape, and comprises a lower surface connected to an end of the iron core of the coil on the base side, and a side surface extending parallel to a side surface of the coil along an axial direction of the coil, the magnet is adhered to a surface of the side surface of the yoke on the contact side, the armature has a substantially L-shaped cross-sectional shape and is pivotably engaged with a tip of the side surface of the yoke, the armature comprises an upper surface facing the other end side of the iron core of the coil, and a side surface along the side surface of the yoke, and the magnet attracts the side surface of the armature in the open contact state, wherein the magnet is arranged at each of two locations on both ends of the side surface of the yoke in a direction perpendicular to the axial direction, in a portion of the side surface of the yoke close to the base, the side surface of the armature comprises two arms which extend from positions close to the upper surface of the armature toward the base side, and each of tips of the two arms faces the corresponding magnet disposed at each of the two locations of the yoke.

* * * * *